US008402717B1

(12) United States Patent
Randazzo

(10) Patent No.: US 8,402,717 B1
(45) Date of Patent: Mar. 26, 2013

(54) WOOD HYBRID LIGHT POLE

(76) Inventor: Lawrence Girard Randazzo, Parker, CO (US)

( * ) Notice: Subject to any disclaimer, the term of this patent is extended or adjusted under 35 U.S.C. 154(b) by 661 days.

(21) Appl. No.: 12/459,628

(22) Filed: Jul. 6, 2009

(51) Int. Cl.
*E02D 27/42* (2006.01)
*E04H 12/00* (2006.01)
*E04H 12/24* (2006.01)
*E04C 3/00* (2006.01)

(52) U.S. Cl. ..... 52/843; 52/836; 52/847; 52/169.13; 52/170; 52/301; 174/45 R

(58) Field of Classification Search ..... 52/834, 52/836, 843, 847, 835, DIG. 8, 233, 169.13, 52/170, 300, 301, FOR. 132, FOR. 152, FOR. 154, 52/FOR. 155, FOR. 162, 244; 174/45 R
See application file for complete search history.

(56) References Cited

U.S. PATENT DOCUMENTS

| | | | | | |
|---|---|---|---|---|---|
| 589,836 | A | * | 9/1897 | Koll | 138/157 |
| 730,789 | A | * | 6/1903 | Neill | 138/157 |
| 1,555,945 | A | | 10/1925 | Cuttle | |
| 1,589,528 | A | | 6/1926 | Hayes | |
| 1,903,907 | A | * | 4/1933 | Riemenschneider | 52/295 |
| 1,972,187 | A | | 9/1934 | Famam | |
| 3,270,480 | A | | 9/1966 | Beecker | |
| 3,360,601 | A | | 12/1967 | Rosenberg | |
| 3,400,905 | A | * | 9/1968 | Van Dusen, Jr. | 403/369 |
| 3,713,262 | A | | 1/1973 | Jatcko | |
| 3,745,331 | A | | 7/1973 | Dennis | |
| 3,746,776 | A | | 7/1973 | Monahan | |
| 4,033,080 | A | | 7/1977 | Fukushima | |
| 4,154,037 | A | * | 5/1979 | Anderson | 52/296 |
| 4,468,273 | A | | 8/1984 | Eklund | |
| 4,779,389 | A | | 10/1988 | Landers | |
| 5,133,164 | A | | 7/1992 | Legler | |
| 5,438,812 | A | * | 8/1995 | Erickson | 52/843 |
| 5,746,031 | A | * | 5/1998 | Burns | 52/170 |
| 5,954,426 | A | * | 9/1999 | Whittington | 362/414 |
| 5,987,845 | A | * | 11/1999 | Laronde | 52/845 |
| 6,006,479 | A | | 12/1999 | Fayle | |
| 6,141,928 | A | * | 11/2000 | Platt | 52/296 |
| 6,446,408 | B1 | * | 9/2002 | Gordin et al. | 52/632 |
| 6,468,003 | B2 | * | 10/2002 | Merjan et al. | 405/253 |
| D496,120 | S | | 9/2004 | Cooper | |
| 7,090,382 | B2 | * | 8/2006 | Haddad et al. | 362/431 |
| 7,490,964 | B2 | * | 2/2009 | Haddad et al. | 362/431 |
| 7,533,506 | B2 | * | 5/2009 | Platt | 52/296 |
| 2004/0154262 | A1 | | 8/2004 | Jaroff | |
| 2006/0185874 | A1 | * | 8/2006 | Bowman et al. | 174/45 R |
| 2008/0271396 | A1 | * | 11/2008 | Burke | 52/301 |
| 2009/0145994 | A1 | * | 6/2009 | Dunn | 242/443 |
| 2010/0281791 | A1 | * | 11/2010 | Intagliata et al. | 52/127.12 |

FOREIGN PATENT DOCUMENTS

KR 878997 B1 * 1/2009

OTHER PUBLICATIONS

English Abstract of KR 87899 B1 to Haing.*
4 pages of printouts from www.aubrilam.com.

* cited by examiner

*Primary Examiner* — Joshua J Michener
*Assistant Examiner* — Ryan Kwiecinski
(74) *Attorney, Agent, or Firm* — Henry L. Smith, Jr.

(57) ABSTRACT

An exemplary embodiment includes a wood hybrid light pole with an internal wireway for electrical wires and a base with anchoring bolts and space for electrical connections.

12 Claims, 6 Drawing Sheets

WOOD HYBRID LIGHT POLE

CROSS REFERENCE TO RELATED APPLICATIONS

U.S. design patent application No. 29314172 filed Mar. 10, 2009.

STATEMENT REGARDING FEDERALLY SPONSORED RESEARCH AND DEVELOPMENT

None

BACKGROUND AND TECHNICAL FIELD

One very useful embodiment of the Invention relates to the following field, although the Invention may also relate to other fields and uses. The Invention may have various embodiments and variations. One aspect of the Invention is as a light pole.

DESCRIPTION OF RELATED ART

Typical of the art related to the more widely useful embodiments of the present Invention are following patents. The following examples of related art and its limitations are illustrative and not exclusive. Other limitations of the related art will become apparent to those skilled in the art upon study of the specification and drawings of this application. Other embodiments of the Invention may relate to other arts and uses. U.S. Pat. No. 3,713,262, Jan. 30, 1973 to Jatcko, discloses a tapered lock break-away pole. U.S. Pat. No. 3,746,776, Jul. 17, 1973 to Monahan et al. discloses a resin coated wooden pole and light standard. U.S. Design Pat. No. D496,120 S, Sep. 14, 2004 to Cooper et al. discloses a light pole.

SUMMARY

One of the more widely useful embodiments of the present Invention may be summarized as follows. This embodiment is exemplary only. Other embodiments will become apparent to those skilled in the art upon study of the specification and drawings of this application. Other embodiments of the Invention may relate to other arts and have usefulness in those arts.

The present invention relates generally to exterior light poles, and more particularly, to a hybrid laminated wood pole that has an aluminum base plate, for anchoring and wiring, and an upper pole section that is laminated wood for supporting a luminaire assembly. Lighting poles are generally made of steel, aluminum or composite materials. These are hollow tubes that provide for an internal electrical wireway, as well as a means of support and mounting the lighting fixture assembly, which may include multiple lighting fixtures. Utility or telephone poles, used mainly for overhead electrical transmission and or communication transmission, can also have lighting fixtures attached to the pole for illumination purposes. Wood utility poles are one continuous, solid wood structure, typically embedded in the ground as a means of mounting.

There are several problems and drawbacks associated with using conventional wood poles when used in a non-utility application such as architectural site lighting, where a lighting assembly will be attached on the top of the pole and connected to an electrical circuit:

a. Utility or telephone transmission poles are typically directly buried in the ground, below grade level, rather than attached to a concrete foundation, at or above grade level, via anchoring bolts. Installing and removing direct embedded wood poles is fairly simple when placed in a open area of soil such as along a roadway. Installing embedded poles in an area with finished grade materials such as concrete, paving stones, landscapes, etc. makes it more complicated and expensive to install and remove the poles. Attaching a pole to a concrete foundation with anchoring bolts is the preferred method of installing a conventional steel or aluminum pole in an area with finished grade materials.

b. Direct buried wood poles are typically coated with a combination of chemicals to retard rotting of the wood, that is below grade, due to moisture, insects and chemicals contained in the soil substrate. These chemicals, some of which are toxic, will leach into the surrounding soil over time.

c. Conventional solid wood poles have no means of internally bringing electrical wires from the base of the pole to the top of the pole. Conduit is necessary to be run alongside the wood pole to encase the electrical wires vertically up the pole. The various embodiments of the present invention address these issues.

PURPOSES AND ADVANTAGES

The invention may have various embodiments and variations and may be useful in different fields and for different purposes. The purposes and advantages of the more widely useful embodiments of the present invention include, but are not limited to, the following, and may include other purposes and advantages in different fields of use not listed herein:

1. To provide a decorative wood hybrid pole used for exterior lighting applications where the visual vocabulary of wood is preferable to a metal pole. The wood hybrid pole can be finished in various wood colors as specified by the user.

2. To provide an internal wireway in the center of the pole for bringing the electrical wires from the base of the pole, at grade level, to the top of the pole.

3. To construct the pole of a laminated wood structure, instead of a single piece of wood used in a wood utility or telephone pole. A laminated wood structure is stronger in compression and under a load than a single piece of homogenous wood.

4. To provide a pole base plate for attaching to a foundation, using conventional anchor bolts, which installs like a metal pole.

5. To provide a pole top tenon for attaching a luminaire, or luminaire and arm assembly, on the top of the pole.

6. To provide that the wood pole is constructed of Alaskan Yellow Cedar wood which is naturally impervious to the intrusion of moisture and insects, without the use of chemical treatments, to avoid deterioration, decay or rotting due to insects and moisture.

The main pole shaft comprises a hollow, laminated wood structure. The laminations are arranged to maximize the strength of the pole shaft when the individual laminations are adhered to each other. The base of the pole is cast aluminum. The base includes four openings for attaching the pole to the foundation with anchor bolts and associated hardware.

7. To provide in the base of the pole, an electrical wiring compartment that complies with the 2008 National Electrical Code requirements for wiring compartments. This will allow connections between the load power source and the lighting fixture or other electrical device on the top of the pole.

8. To provide an integral electrical wiring compartment in the base, as well as the anchor, bolts, which are covered by a gasketed, watertight cover to preclude the intrusion of water and dirt into the base area of the pole.

9. To provide a structure where the wood shaft slips into the outer aluminum base tube section.

REFERENCE NUMERALS IN DRAWINGS

100 tenon assembly
101 circular tenon
102 tenon plate
103 inner sleeve
200 wood shaft
201 passageway or wireway
202 laminated planks
300 anchor base
301 center shaft
302 bottom horizontal plate
303 raised rim
304 radial ribs
307 holes
310 wire access compartment
311 open passage
312 cavity
313 base
320 cover disk
321 circular gasket
322 flat gasket
323 cover disk holes
324 cover disk bolts
500 foundation
501 anchoring bolts
502 anchoring nuts
503 wires
504 conduit
505 wires
506 wire nut connectors
601 luminaire
602 luminaire arm assembly

BRIEF DESCRIPTION OF THE DRAWINGS

This Brief Description and the Detailed Description Of The Drawings cover only some embodiments of the Invention, and other embodiments will be clear to those skilled in the art from the description, drawings, and Alternative and Additional Embodiments, etc.

The Drawings are illustrative and not limiting.

DETAILED DESCRIPTION OF THE DRAWINGS

Figure 1:
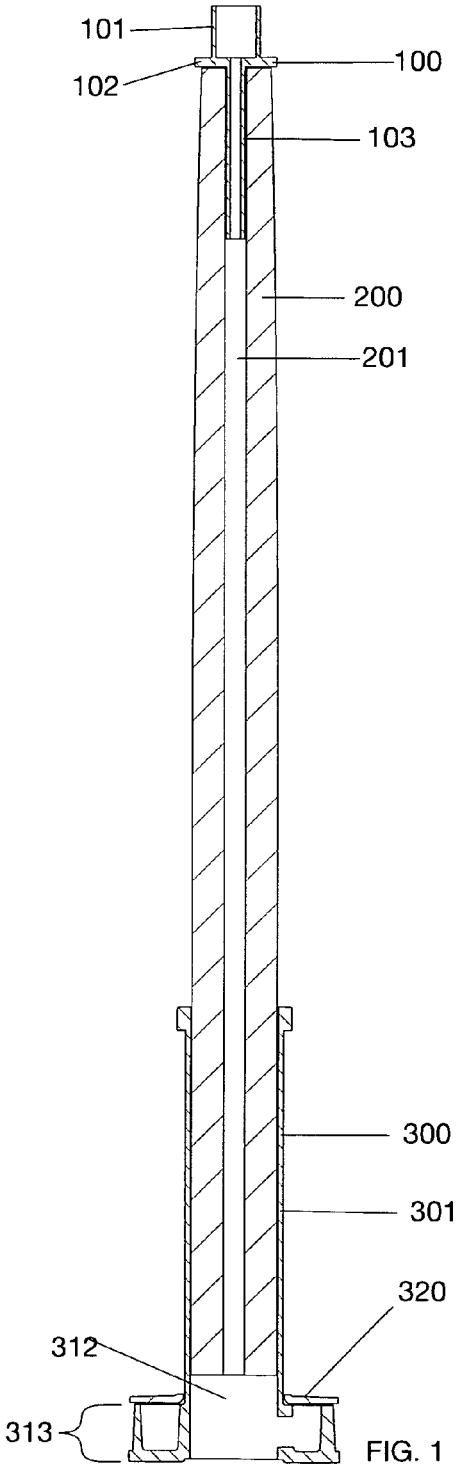
FIG. 1 shows a cross section of the pole and internal parts.

FIG. 1 shows a cross section of the pole or wood shaft. The tenon assembly 100 has a circular tenon 101 that accepts a lighting fixture and or bracket arm to slip over the outside perimeter of the circular tenon 101. The circular tenon 101 can be of different combinations of diameter and height to accommodate a wide range of light fixtures and or bracket arms. The tenon 100 assembly has an integral tenon plate 102 that acts as a stop for the light fixture or bracket arm that is received over the circular tenon 101. The tenon plate 102 is permanently sealed to the top of the wood shaft 200 to protect the top end of the wood shaft 200 from environmental elements such as rain, sunlight and insects. The inner sleeve 103 provides a passageway for electrical wires connecting the light fixture at the top of the pole to the electrical power connection at the base of the pole. The wood shaft 200 is comprised of planks of wood adhered together longitudinally to form a laminated beam. The planks are adhered with an exterior grade adhesive, held under pressure until the adhesive is cured. The planks are continuous pieces of wood the entire length of the wood shaft. The laminated wood shaft is machined into a tapered shaft of various lengths. The wood shaft 200 is hollow with a passageway 201 for electrical wires connecting the light fixture at the top of the pole to the electrical power connection at the base of the pole. The wood shaft 200 is preferably comprised of Alaskan yellow cedar wood planks. Other wood species can be used to form the wood shaft 200. The Alaskan yellow cedar wood is used because of its natural resistance to moisture and insects, without the use of chemical treatment for moisture and insect protection. The wood shaft 200 is permanently attached to the anchor base 300, inside the vertical center shaft 301. The Figure also shows cover disk 320 attached to the base 313.

Figure 2:
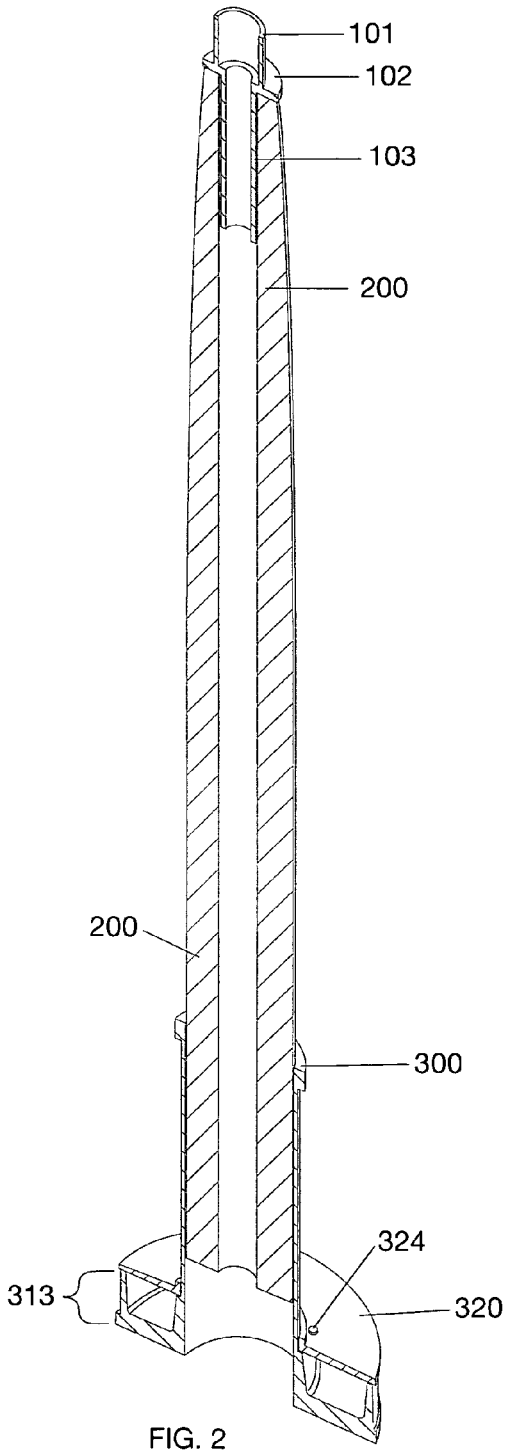
FIG. 2 is similar to FIG. 1 but in perspective.

FIG. 2 is a cross section of the pole which shows the circular cover disk 320 which is attached to the lower portion of the anchor base 300 and base 313 with cover disk bolt 324 which fastens cover disk 320 to the bottom of anchor base 300 through cover disk holes not shown. See FIG. 10.

Figure 3:
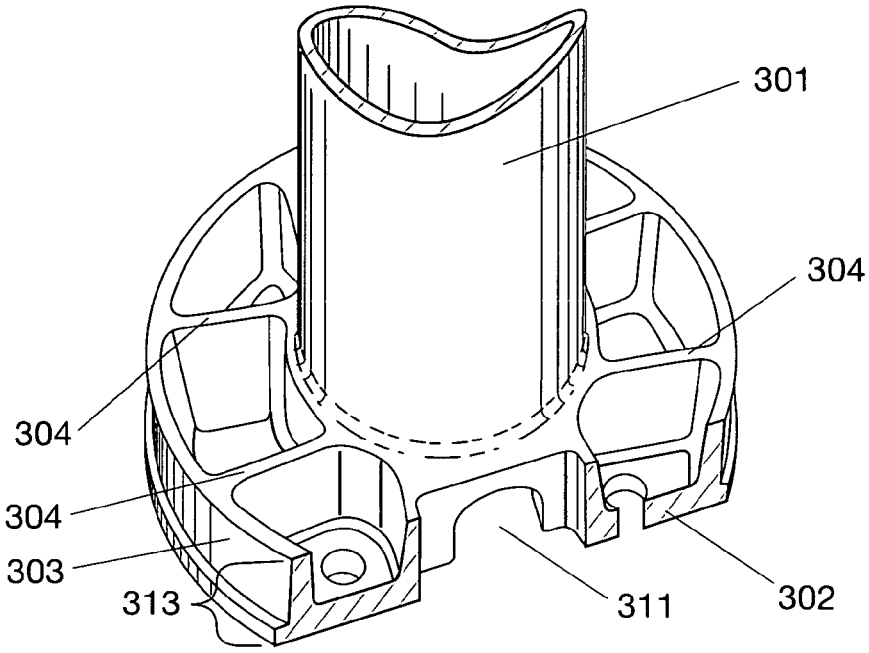
FIG. 3 is a perspective and partial section, at the open passage, of the base.

FIG. 3 shows the lower portion of the anchor base 300 and base 313 with outer round raised rim 303 that has radial ribs 304 that project out from the center shaft 301 to the raised rim 303. This design provides structural strength to the assembly. The cut away also shows the open passage 311 at the lower portion of the base 313 to the center of the pole passageway 201, not shown.

Figure 4:
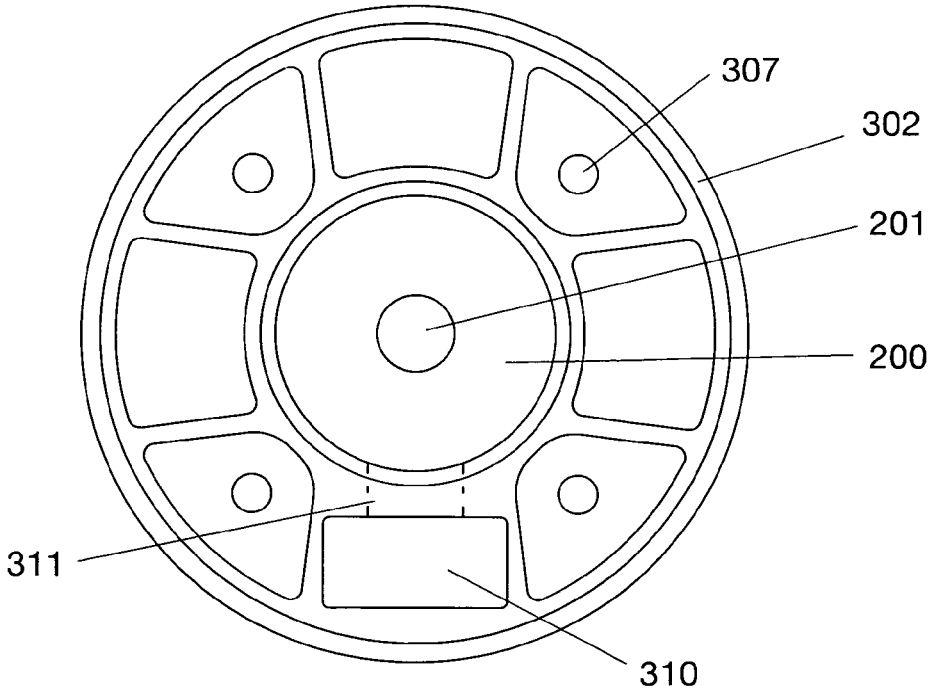
FIG. 4 is a plan view, looking down, of the base.

FIG. 4 shows a plan view of the lower part of base 313 which includes the bottom horizontal plate 302 portion of the base 313 with four holes 307 equidistant around the circumference of a circle to provide for attaching the base 313. The wire access compartment 310 is shown with the open passage 311 to the center passageway 201 of the wood shaft 200.

Figure 5:
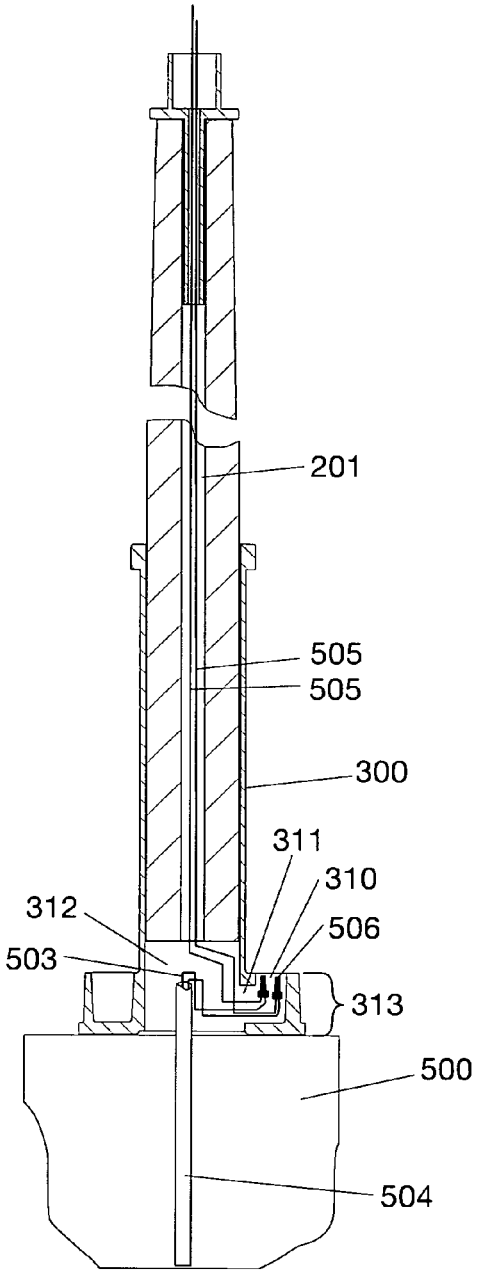
FIG. 5 is a sectional view of the wood shaft installed on the ground, showing internal wiring.

FIG. 5 is a cross section of the anchor base 300 and base 313 which has an integral wire access compartment 310 that has an open passage 311 to the cavity 312 at the base of the pole. Electrical wires 503 in conduit 504 are normally situated in the foundation 500. The pole has a cavity 312 to contain the conduit 504 and wires 503. The wires are routed through the open passage 311 to the wire access compartment 310. The wires 505 extend vertically from to top of the pole to the wire access compartment 310. This wire access compartment 310 allows for electrical connections between the electrical wires 503 and 505 to be made after the pole is anchored. Wire nut connectors 506 are shown connecting wires 503 and 505.

Figure 6:
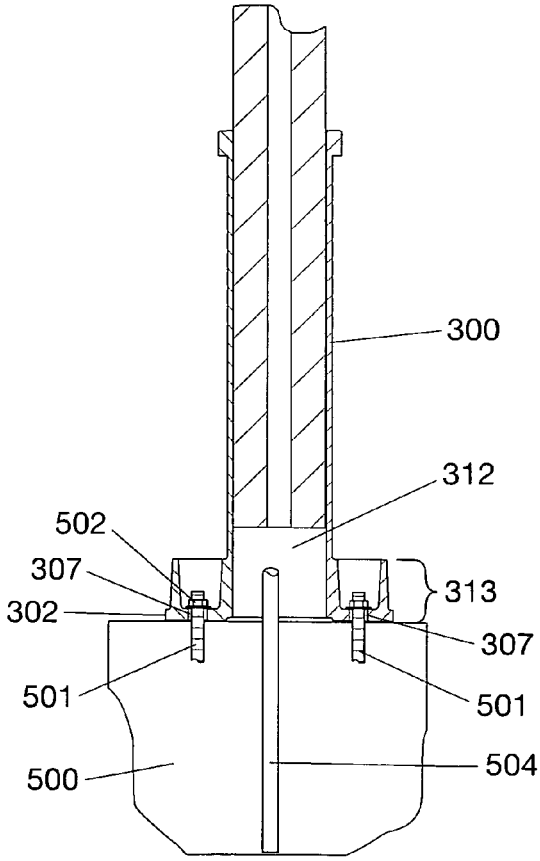
FIG. 6 is similar to FIG. 5 but showing anchoring bolts.

FIG. 6 shows a cross section detail of the anchoring of the pole to a suitable foundation 500. Four anchoring bolts 501 affixed to the foundation 500 extend vertically through the base holes 307. The anchoring nuts 502 are tightened down onto the bottom horizontal plate 302 of base 313 to secure the pole to the foundation 500. Cavity 312 and conduit 504 are also shown.

Figure 7:
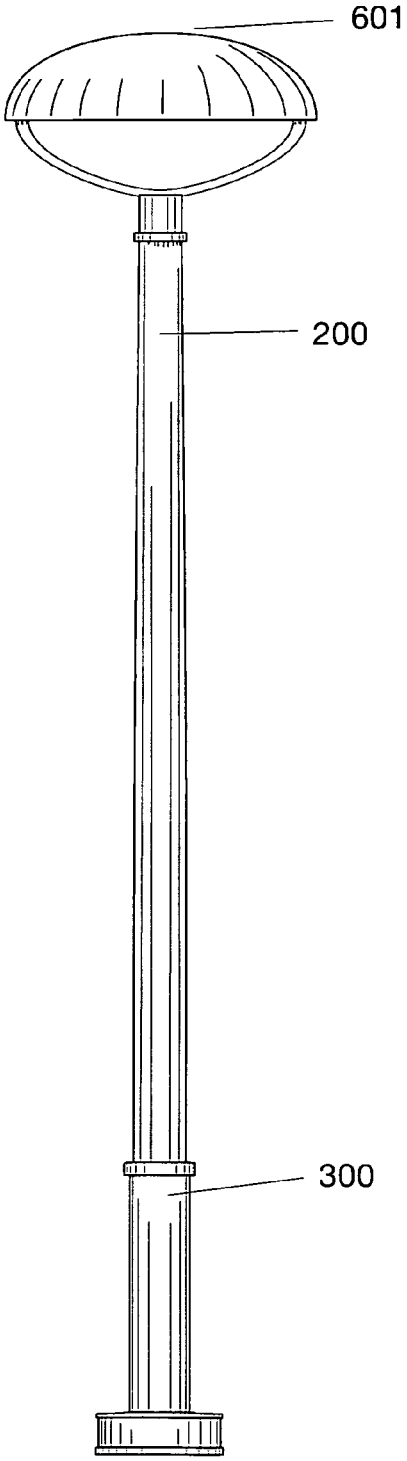
FIG. 7 shows anchor base 300, the wood shaft 200, with a luminaire mounted to the wood shaft.

FIG. 7 shows the anchor base 300, wood shaft 200, with a luminaire 601 slipped over the circular tenon 101 (not shown).

Figure 8:
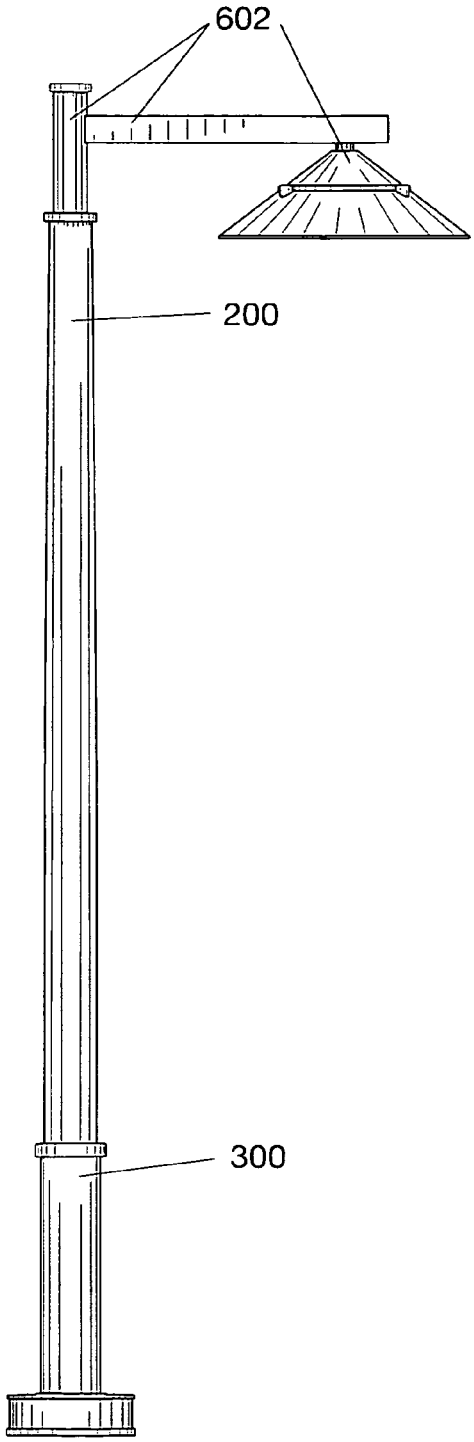
FIG. 8 shows a lunimaire and arm assembly mounted to the wood shaft.

FIG. 8 shows a fixture with luminaire arm assembly 602, with the assembly 602 slipped over the circular tenon 101 (not shown).

Figure 9:
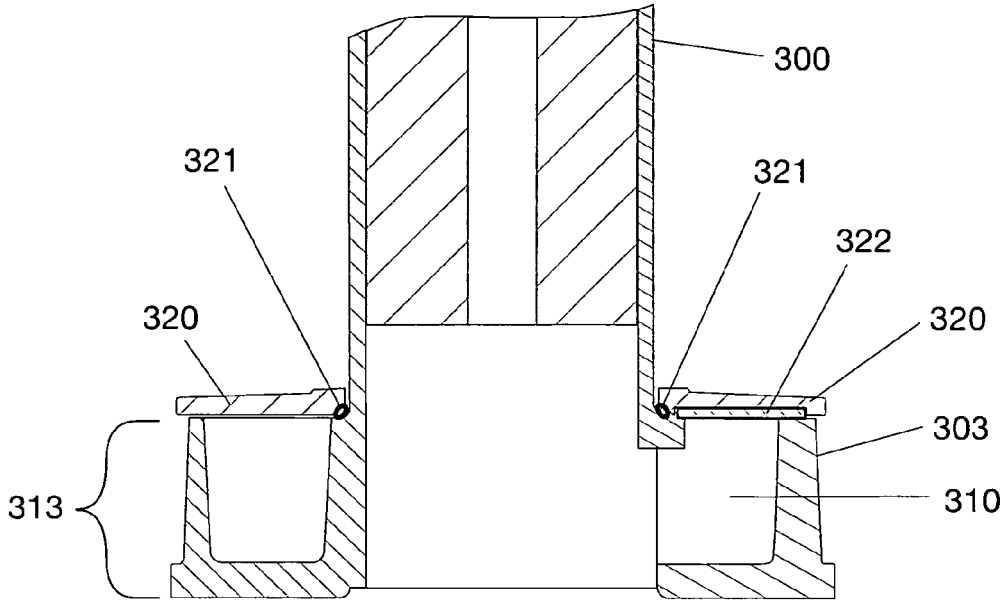
FIG. 9 shows a cross section of the base with the cover disk and gaskets.

FIG. 9 is a cross sectional view of the lower part of the base 313 with the cover disk 320. A continuous one piece, silicone gasket, round in cross section 321, is captured and compressed by the cover disk 320, when the cover disk is secured to the base 313 with four stainless steel bolts 324 (see FIG. 2). This prevents the intrusion of water into the voids between the ribs 304 (see FIG. 3) and the raised rim 303 of the base 313. The flat gasket 322 seals the wire access compartment 310.

Figure 10:
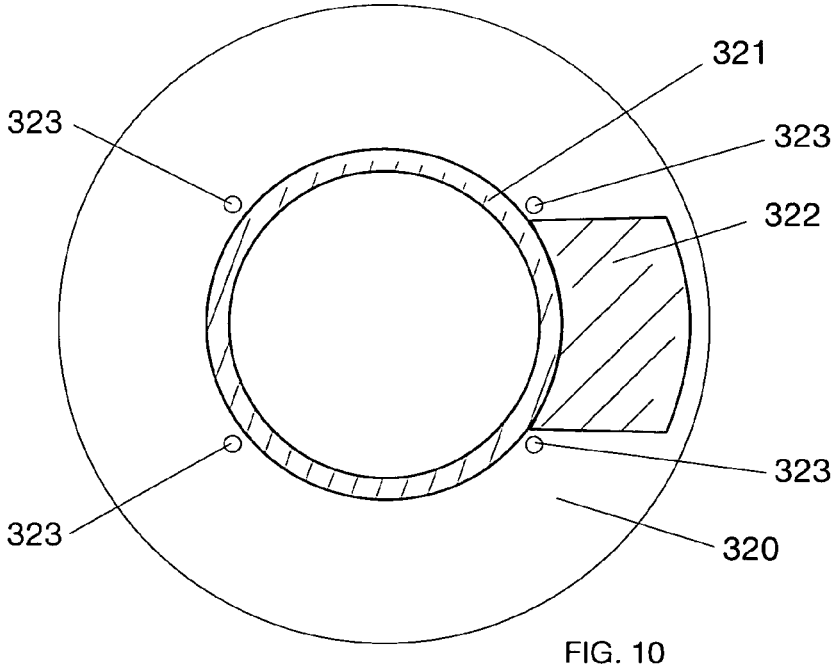
FIG. 10 shows the cover disk with the flat gasket in place.

FIG. 10 shows the underside of cover disk 320 with the flat gasket 322, and the flat circular gasket 321 in position on the cover disk 320 and the four cover disk holes 323 for the cover disk bolts 324 not shown. Gasket 322 seals the wire access compartment from water and solid contaminants.

Figure 11:
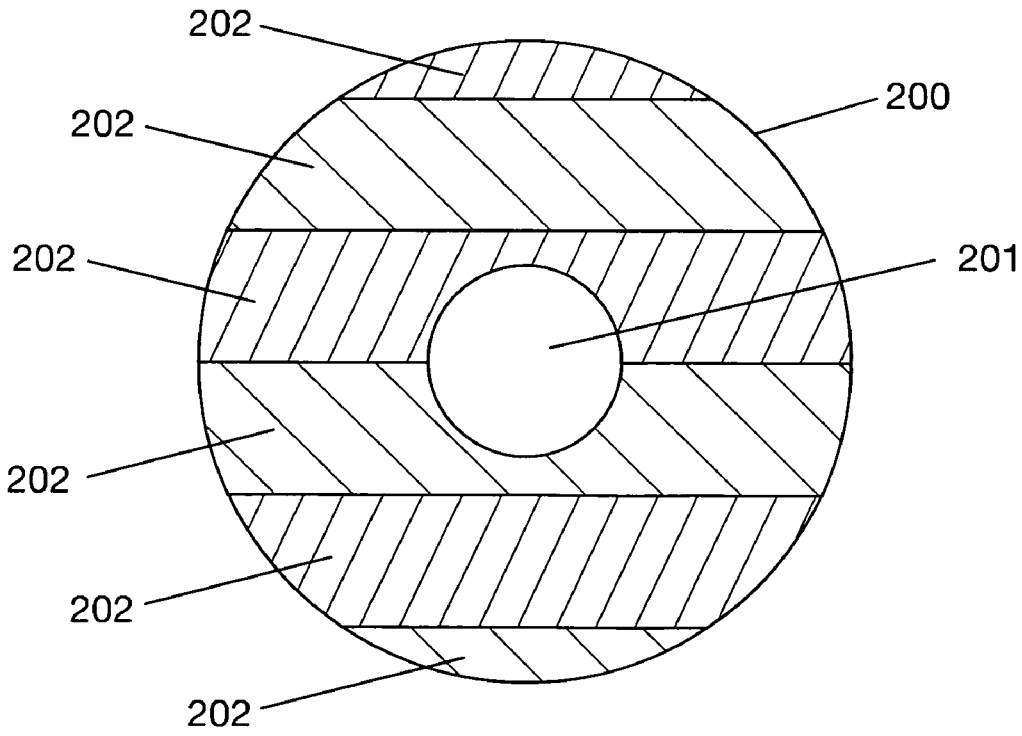
FIG. 11 shows a cross section of the laminated wood shaft.

FIG. 11 shows a cross section of the wood shaft 200, shown with six laminated planks 202 and 201 wireway. The number of laminations can be adjusted from four to eight in cross section depending on the thickness of the planks used.

DESCRIPTION

Preferred Embodiment

The preceding description is the embodiment presently preferred by the Inventor, but over time other embodiments and uses in other areas may become preferred to those skilled in the art. The materials for the pole, apart from the wood, could be various metals or perhaps certain strong plastics. The dimensions could vary based on aesthetic appearance, and the height could vary based on installation location and lighting requirements.

Tests of One Embodiment

The hybrid pole was tested for failure under load using the static load testing method, measuring the load with a dynamometer. The test method was per ASTM 136.20. Multiple poles were tested until failure. Failure occurred at 1205 to 1210 pounds. This compares favorably to high strength composite poles that fail at 300 to 400 pounds using identical testing methods. The testing was conducted on Dec. 8, 2008. The test data was inputted into a "load" program to determine the acceptable wind loading of the pole under various conditions. This is the standard method of determining the maximum weight and EPA (effective projected area) of luminaires and arms that can be attached to the top of the pole under specific wind conditions.

Alternative Embodiments

Other species of wood can be used to form the wood shaft, although most types of wood, such as Douglas Fir, pine, oak, etc. require chemical treatment to protect the wood from water and insect damage. Hardwoods such a teak and ipe, which are resistant to water and insect damage, do not accept adhesives well and are prone to failure at the glue joints.

An alternative method of installing the pole would be a direct embedment whereas the pole extends below the finished grade. The pole base would be constructed of stainless steel instead of aluminum to resist corrosion on the portion of the base that is below grade, and in direct contact with soil.

The wood shaft can be attached to the base by means of mechanical attachments such as screws or bolts as opposed to using a structural adhesive. Mechanical attachments are prone to long term failure due to the natural occurrence of pole vibration due to the wind which will enlarge the mounting holes.

The wood shaft 200 and the vertical portion 301 of the anchor base 300 can be produced as a square shape in cross section rather than round as shown in the drawings.

CONCLUSIONS, RAMIFICATIONS AND SCOPE

A number of changes are possible to the parts described above while still remaining within the scope and spirit of the Invention. The specifics about the form and use of the Invention described in this application (including the specifics in the Summary, Abstract, Preferred Embodiment, Additional Embodiments, and Alternative Embodiments, etc.) are examples and are not intended to be limiting in scope. Those skilled in the art will recognize certain modifications, permutations, additions, subtractions and sub-combinations thereof, and may discover new fields of use. The scope of the Invention is to be determined by the claims and their legal equivalents, not the examples, purposes, summary, preferred embodiments, alternative or additional embodiments, operation, tests, parameters, or limitations etc. given above. It is intended that the claims are interpreted to include all such modifications, additions, subtractions, permutations and sub-combinations as are within their true spirit and scope, including those which may be recognized later by those skilled in the art.

I claim:

1. A wood hybrid light pole adapted to be secured to a foundation, comprising:

(a) two or more longitudinally laminated pieces of wood held together by an adhesive to form an elongated generally cylindrical wood shaft, (b) a hollow cylindrical anchor base including a center shalt into which the wood shaft fits to the extent of a portion of the wood shaft's length, and adapted to be secured to a foundation, (c) a hollow substantially cylindrical passageway inside the wood shall extending the full length of the wood shaft and positioned substantially along the center line axis of the wood shaft, and (d) a tenon assembly inserted into the opening of the passageway at the top of the pole, wherein the tenon assembly comprises a circular tenon at the assembly's top and a hollow inner sleeve positioned down into the passageway of the pole, and a tenon plate between the circular tenon and the inner sleeve of the tenon assembly, said tenon plate rests substantially flush on the top of the pole, whereby the pole can be secured to a foundation and whereby electric wires can pass from one end of the pole to the other in the passageway.

2. The pole of claim 1, wherein the hollow cylindrical anchor base further comprises a larger base at the anchor base's bottom end adapted to be secured to a foundation.

3. The pole of claim 2, wherein the larger base includes a cavity in the larger base openly connected to the bottom of the passageway inside the wood shaft, and a bottom horizontal plate including two or more holes, through which anchoring bolts may pass into the foundation, whereby said bolts and associated anchoring nuts can secure the larger base to the foundation.

4. The pole of claim 3, further comprising an open passage in the larger base opening to the outside perimeter of the larger base and in open communication with the cavity which in turn is in open communication with the passageway.

5. The pore of claim 4, further comprising a raised rim portion of the larger base and two or more radial ribs extending from the center shaft of the anchor base radially to the raised rim of the larger base, which raised rim is connected to the bottom horizontal plate of the larger base.

6. The pole of claim 5, further comprising a hollow wire access compartment in the larger base in open communication with the open passage which in turn is in open communication with the open passageway in the wood shaft, whereby electric wires may extend from a conduit in the foundation, or through the open passageway in the larger base, into the bottom of the passageway in the wood shaft, up to and through the inner sleeve, tenon plate, and circular tenon.

7. The pole of claim 6, further comprising a cover disk, substantially annular in shape, the inside perimeter of which is positioned around the center shaft, and the outside edge of which is positioned along and on top of the raised rim.

8. The pole of claim 7, further comprising a narrow circular gasket positioned between the cover disk and the center shaft, whereby water and particulate matter can be prevented from entering the larger base between the center shaft and the cover disk.

9. The pole of claim 8, further comprising a flat gasket somewhat larger than the top of the wire access compartment, capable of being positioned under the cover disk and over the top of the wire access compartment in the base, whereby leaks of water and other matter are prevented into the wire access compartment.

10. The pole of claim 9, further comprising two or more cover disk holes in the cover disk capable of receiving cover disk bolts for attachment to the base.

11. A wood hybrid light pole adapted to be secured to a foundation, comprising:

(a) two or more longitudinally laminated pieces of wood held together by an adhesive to form an elongated generally cylindrical wood shaft, (b) a hollow cylindrical anchor base including a center shaft into which one end of the wood shaft fits to the extent of a portion of the wood shaft's length, wherein the hollow cylindrical anchor base further comprises a larger base at the anchor base's bottom end adapted to be secured to a foundation, (c) a hollow substantially cylindrical passageway inside the wood shaft extending the full length of the wood shaft and positioned substantially along the center line axis of the wood shaft, and (d) a tenon assembly inserted into the opening of the passageway at the top of the pole, wherein the tenon assembly comprises a circular tenon at the assembly's top and a hollow inner sleeve positioned down into the passageway of the pole, and a tenon plate between the circular tenon and the inner sleeve of the tenon assembly, which tenon plate rests substantially flush on the top of the pole, whereby the pole can be secured to a foundation and whereby electric wires can pass from one end of the pole to the other in the passageway.

12. A wood hybrid light pole adapted to be secured to a foundation, comprising:

(a) two or more longitudinally laminated pieces of wood held together by an adhesive to form an elongated generally cylindrical wood shaft, (b) a hollow cylindrical anchor base including a center shaft into which one end of the wood shaft fits to the extent of a portion of the wood shaft's length, wherein the hollow cylindrical anchor base further comprises a larger base at the anchor base's bottom end adapted to be secured to a foundation, wherein the larger base includes a cavity in the larger base openly connected to the bottom of the passageway inside the wood shaft, and a bottom horizontal plate including two or more holes, through which anchoring bolts may pass into a foundation, whereby said bolts and associated anchoring nuts can secure the larger base to a foundation, (c) a hollow substantially cylindrical passageway inside the wood shaft extending the full length of the wood shaft and positioned substantially along the center line axis of the wood shaft, and (d) a tenon assembly inserted into the opening of the passageway at the top of the pole, wherein the tenon assembly comprises a circular tenon at the assembly's top and a hollow inner sleeve positioned down into the passageway of the pole, and a tenon plate between the circular tenon and the inner sleeve of the tenon assembly, which tenon plate rests substantially flush on the top of the pole, whereby the pole can be secured to a foundation and whereby electric wires can pass from one end of the pole to the other in the passageway.

* * * * *